US007124704B1

(12) United States Patent
Strom

(10) Patent No.: US 7,124,704 B1
(45) Date of Patent: Oct. 24, 2006

(54) MULTI-PURPOSE STORAGE RACK AND FISHING TROLLER FOR A PERSONAL WATER CRAFT

(76) Inventor: Kraig Strom, 2945 Stonewall, Corona, CA (US) 92882

( * ) Notice: Subject to any disclaimer, the term of this patent is extended or adjusted under 35 U.S.C. 154(b) by 18 days.

(21) Appl. No.: 11/044,107

(22) Filed: Jan. 27, 2005

(51) Int. Cl.
*B63B 17/00* (2006.01)

(52) U.S. Cl. ..... 114/364

(58) Field of Classification Search ..... 114/55.5, 114/364

See application file for complete search history.

(56) References Cited

U.S. PATENT DOCUMENTS 6,189,753 B1 * 2/2001 Kalhok et al. ..... 224/406
2002/0045417 A1 * 4/2002 Homer, Sr. ..... 452/189
2002/0088661 A1 * 7/2002 Gagnon et al. ..... 180/248
2003/0066853 A1 * 4/2003 Hebert ..... 224/401

* cited by examiner

*Primary Examiner*—Stephen Avila
(74) *Attorney, Agent, or Firm*—Kirk A. Buhler; Buhler & Associates

(57) ABSTRACT

The present invention is for an apparatus for use on a personal water craft having a hull, a deck disposed on the hull, a hood movably connected to the forward portion of the deck, an engine position with in the hull, a seat mounted atop the deck for accommodating at least one rider and comprising: at least one multi-purpose rack is bolted to the personal water craft; wherein at least a portion of the multi-purpose rack is disposed forward of the seat; wherein at least a portion of the multi-purpose rack extends outwardly from the hood to a peripheral edge of the water craft; and wherein the multi-purpose rack has a surface for carrying one or more items. Wherein the multipurpose rack can hold and store items such as fishing equipment, camping equipment, water skies, wake boards, scuba diving equipment, and inner-tubes on the personal water craft.

20 Claims, 3 Drawing Sheets

MULTI-PURPOSE STORAGE RACK AND FISHING TROLLER FOR A PERSONAL WATER CRAFT

FIELD OF THE INVENTION

The field of the invention relates to personal water crafts. Specifically, a multi-purpose storage rack and fishing troller for personal water crafts.

BACKGROUND OF THE INVENTION

An enormous problem that personal water crafts have always encountered is a lack of storage space. Personal water crafts generally only provide storage space in the bow and glove box of the personal water craft. Since personal water crafts are so small, they do not have large storage space for storing items such as fishing equipment, camping equipment, hunting equipment, water skies, wake boards, scuba diving equipment, inner-tubes and other such articles or items.

Carriers or racks have been employed on small vehicles for lashing of goods to the vehicle for transportation. Such racks often include a frame structure of tubular material fixed to the frame of the vehicle. Such racks are located behind the rider extending across the upper rear portion of the vehicle.

Although carriers or racks are commonly utilized with motorcycles, ATVs, farm vehicles, fishing boats and hunting boats, such racks have not been utilized for use with personal water crafts. Additionally, carriers or racks are often attached to the rear of the vehicle. However, attaching a rack to the rear of the personal water craft could be dangerous, as riders often fall off to the side and back of the water craft.

The personal water crafts that we use and see today have dramatically evolved from the single cylinder engine and the single person water crafts of the of the 1960's. The personal water crafts of today provide more stability, maneuverability, versatility, control, acceleration, torque and power. In fact, today's personal water crafts can accommodate as many as four people.

Early personal water crafts were equipped with a single cylinder engine which reached speeds of approximately 25 to 30 mph. Those water crafts were only used for recreational riding activities. The water crafts were not designed with enough acceleration, torque and horse power to pull water skiers, wake boarders, and inner tubers. In comparison, today's personal water crafts can reach speeds of over 60 miles per hour with the power of more than 215 hp.

The original personal water crafts had hulls that were flat, which caused the water craft to turn "wide" encompassing a large surface area. Conversely, today's personal water crafts utilize a hull that is v-shaped which allows the water craft to make "tighter" and more narrow turns in the water. Additionally, some personal water crafts have also utilized two hulls, which creates more stability in the vehicle. As a result of this added stability, personal water crafts of today can be utilized by more than one person at a time.

The improvements in the design of the hull as well as other areas of the personal water crafts have increased their maneuverability and stability, allowing today's personal water crafts to be utilized in a variety of activities.

Another feature that has helped increase the versatility of personal water crafts is that they are equipped with forward/neutral/reverse, capabilities which allows users more control in the operation of the water craft. This option similarly contributes to the versatility and function of the present day water crafts.

In comparison to any boat, personal water crafts are smaller in size. As such, they afford the user a number of additional functions not available in a boat. The water craft can maneuver in tight corridors, go up or down small rivers or streams, and even traverse swamps. Personal water crafts also allow access to shallow areas of water.

Only recently were personal water crafts designed with the added acceleration, torque and horse power to pull the weight of water skiers, wake boarders, and inner tubers alike. As such, a user can now use the personal water craft to engage in activities that were once impossible.

Although, the design of the personal water craft evolved to allow for more power and function, it has not made any adjustments to increase storage space. Skiers have to physically hold their water skies or their wake boards; and scuba divers have to hold their scuba diving equipment while riding in a personal water craft. To accommodate the increasing number of uses for personal water crafts a need exists for a device that will conveniently store or house the various accessories such as fishing equipment, camping equipment, hunting equipment, water skies, wake boards, scuba diving equipment, and inner-tubes.

Water skiing, wake boarding, scuba diving and inner-tubing are examples of popular water activities that require the use of a boat. Unfortunately, not everyone can afford their own boat to engage in such activities. Since personal water crafts are more affordable and now have the power, a user can utilize a personal water craft to engage in water skiing, wake boarding, scuba diving and inner-tubing. Due to the lack of storage space on personal water crafts, users have to hold their water skies, wake boards, or scuba gear in their hands until they reached the designated location for the activity. However, if personal water crafts were equipped with a multipurpose storage rack for holding and/or storing items, personal water crafts would be more often utilized for such activities.

Similarly, hunting for water fowl, such as but not limited to duck hunting, was only carried out by using a boat. However, now that personal water crafts provide more stability, control, maneuverability and power and are more affordable than boats, a personal water craft can be utilized in hunting activities. Since personal water crafts of today do not have a multipurpose storage rack for holding and/or storing items for such hunting activities, a multipurpose storage rack needs to be developed for personal water crafts.

Fishing is another activity engaged in from a boat. Due to the added stability and control of personal water crafts, personal water craft can now be considered a viable option for a user to engage in fishing. Utilizing a personal water craft to engage in fishing would be ideal since the size and maneuverability of the personal water craft would allow the fisherman to access areas that are impossible to reach with fishing boats. However, since personal water craft of today do not have a multipurpose storage rack for holding and/or storing items such as a fishing pole, tackle box, and a trolling motor for use in fishing, a multipurpose storage rack needs to be developed for personal water crafts.

With the ability to engage in additional activities, there exists a substantial need in the art for an improved personal water craft that can store the equipment necessary to engage in various activities. By utilizing a personal water craft that is equipped with a multipurpose storage rack, the user can engage in any of a number of activities with the convenience of transporting with ease related gear, equipment and the like.

Personal water crafts of today do not have the capacity to store anything on the exterior of the water craft. (ie. fish equipment, hunting equipment, camping equipment, wake boarding equipment, water skiing equipment, inner-tubing equipment, scuba diving equipment and the like. As such, this invention seeks to address those needs.

SUMMARY OF INVENTION

It is an object of the present invention to increase the capacity of a personal water craft to carry and store items such as fishing equipment, hunting equipment, camping equipment, water skies, wake boards, scuba diving equipment, inner-tubes and other articles or items.

It is another object of the present invention to have a multipurpose storage rack that will not require a user to open the hood of the water craft in order to access various articles or items.

It is another object of the present invention to have a multipurpose storage rack that will not prohibit a user from opening the hood to accessing items contained in the hood.

It is another object of the present invention to utilize a personal water craft having a multipurpose storage rack for storing items such as fishing equipment, hunting equipment, camping equipment, water skies, wake boards, scuba diving equipment, and inner-tubes as well as other articles or items on the exterior of the vehicle.

It is another object of this invention to provide a personal water craft that has a multipurpose storage rack, which provides a way to store items on the surface of the personal water craft or on the front section of the surface of the personal water craft.

It is another object of the present invention to provide a personal water craft that has a multipurpose storage rack that is simple to construct easy to install, economical to manufacture, and reliable in operation and use.

It is another object of the present invention to provide a method for using a personal water craft having a multipurpose storage rack for storing items such as fishing equipment, camping equipment, water skies, wake boards, scuba diving equipment, and inner-tube as well as other articles or items.

It is another object of this invention to provide a multipurpose storage rack that has a means to attach and permanently connect the multipurpose storage rack to the personal water craft.

It is another object of this invention to utilize suitable sealing material to prevent water from seeping into the personal water craft.

It is another object of this invention to provide a multipurpose storage rack that has a means to temporarily connect the multipurpose storage rack to the personal water craft. When the multipurpose storage rack is detached from the personal water craft, it is an object of this invention to utilize plugs to prevent water from seeping into the personal water craft.

It is another object of this invention to utilize a personal water craft for fishing.

It is another object of this invention to utilize a personal water craft that is equipped with a "trolling motor" for fishing.

It is another object of this invention to utilize a personal water craft that has means for attaching a trolling motor to it.

It is another object of this invention to provide a method of using a personal water craft for fishing.

It is another object of this invention to provide a method for fishing using a personal water craft that has a trolling motor.

In addition to the above objects, various other objects of this invention will be apparent from careful reading of the specifications which include the detailed description contained herein below.

BRIEF DESCRIPTION OF DRAWINGS

These as well as other features of the present invention will become apparent upon reference to the accompanying drawings wherein like numerals designate corresponding parts in the several figures which are summarized as follows.

Other features and advantages of the invention will become apparent from the following detailed descriptions, taken in conjunction with the accompanying drawings, which illustrate, by way of example, various features of the invention.

DETAILED DESCRIPTION OF PREFERRED EMBODIMENT

The following detailed descriptions and accompanying drawings are provided for the purpose of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and scope of this invention.

Figure 1:
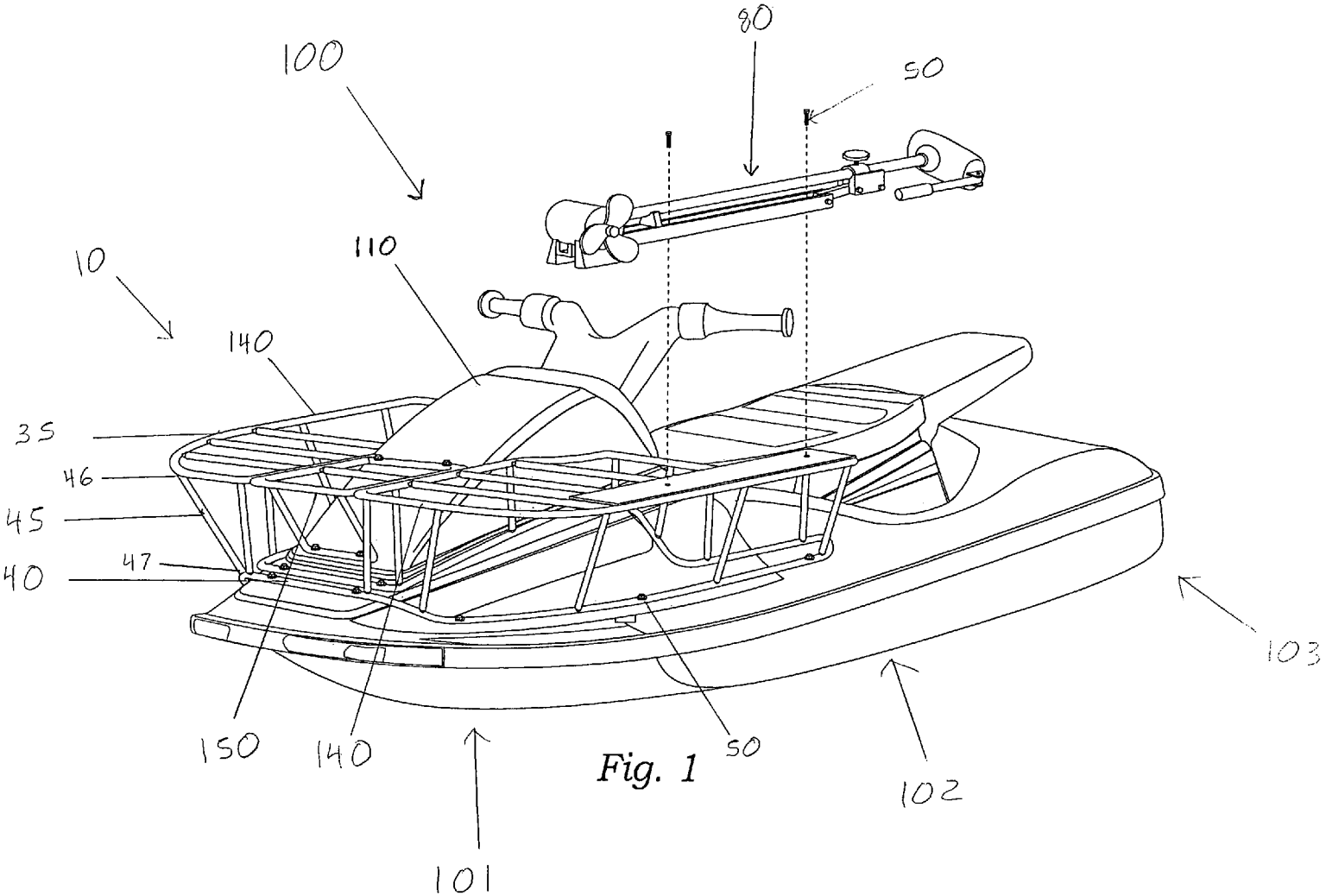
FIG. 1 is a front view of the multipurpose storage rack attached to a personal water craft. The multipurpose storage rack has means for attaching a trolling motor.
Figure 2:
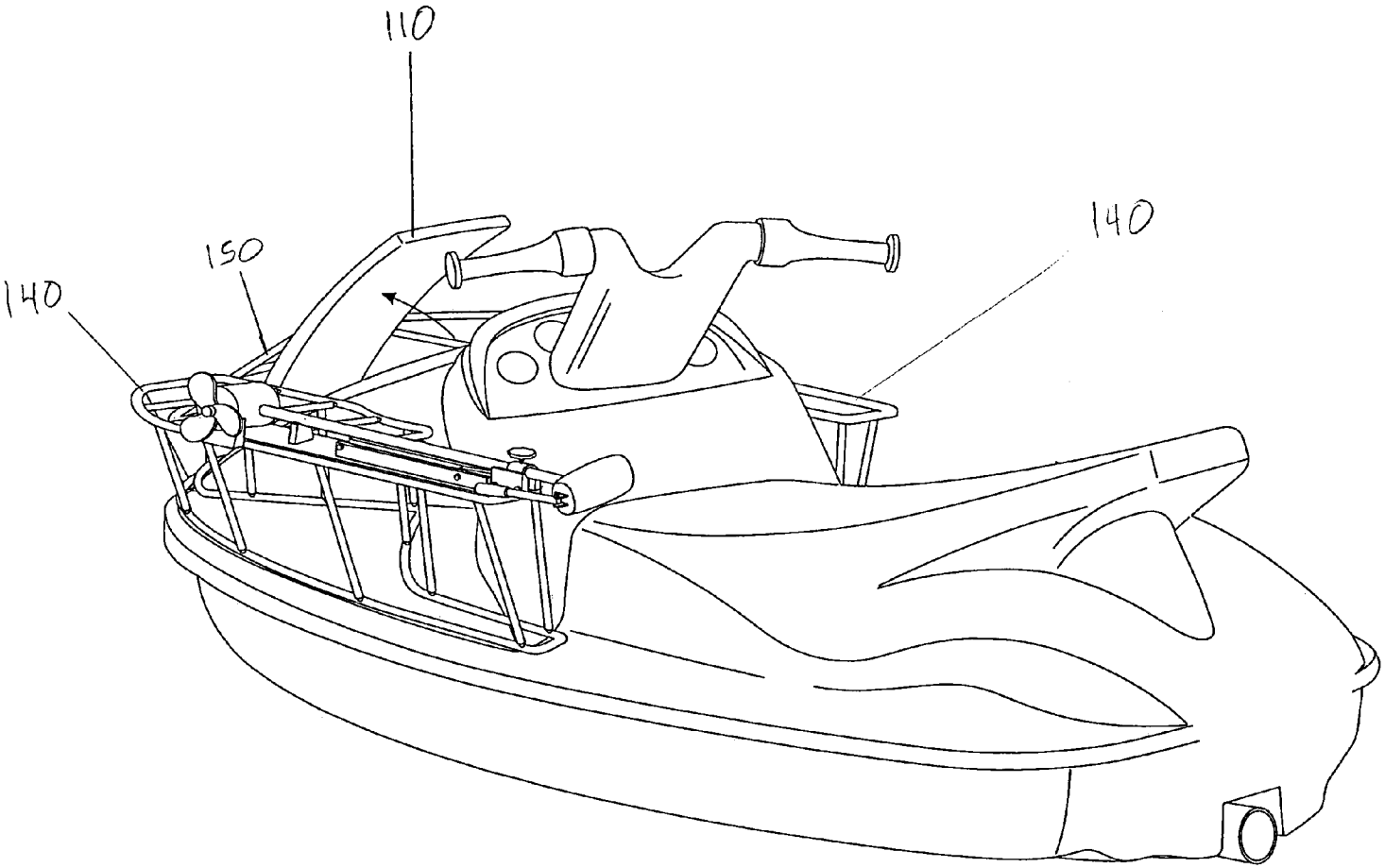
FIG. 2 is a rear view of the multipurpose storage rack attached to a personal water craft with the trolling motor attached to the multipurpose storage rack. The rear view also shows that the hood of the personal water craft can be opened. When the hood is opened, a portion of the storage rack that is attached to the hood of the personal water craft easily tilts to accommodate the opened hood.
Figure 3:
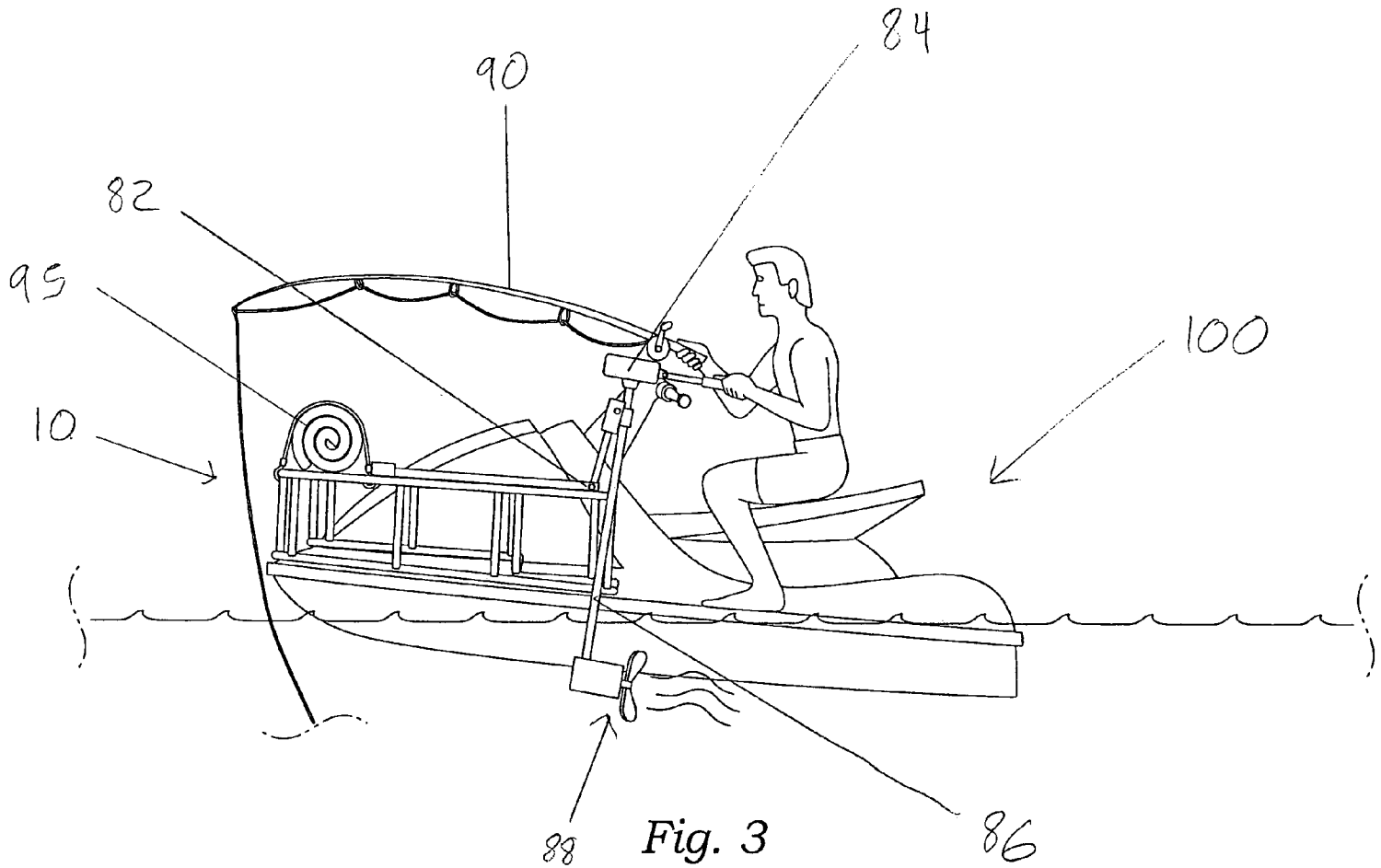
FIG. 3 is a side view of a personal water craft showing a multipurpose storage rack with a sleeping bag and a trolling motor attached to the storage rack. This side view also shows a person operating the trolling motor while fishing.

Turning now to the drawings as seen in FIGS. 1–3, the multipurpose storage rack of the present invention is specifically for use with a personal water craft.

Referring to the drawings more particularly by reference numbers, FIGS. 1 through 3 show a personal water craft 100 having a front section 101, middle section 102, and a rear section 103 and a multi-purpose storage rack 10 of the present invention, which is attached to the front section 101 of a personal water craft 100.

The multi-purpose storage rack 10 of the present invention has a tubular metal frame constructed of upper crossed members 35, lower base members 40, and vertical support members 45.

The vertical support members 45 have a top end 46 and a bottom end 47, which are welded to the respective upper crossed members 35 and lower base members 40.

The lower base members 40 are attached to the front section 101 of the personal water craft by means of bolts 50 or other suitable means for attaching said lower base members 40 to said personal water craft 100. The front section encompasses the bow, the front port side (left side), and the front starboard side (right side) of the personal water craft 100. The lower base members 40 can be attached to the deck, bow, shield, hood, and/or body of the personal water craft. Suitable sealing material will be used to prevent water from seeping into the body of the personal water craft.

The upper crossed members 35 are positioned on the bow, port side, starboard side, and hood of the personal water craft 100. The upper crossed members 35 extend outwardly from said hood 110 to the peripheral edge of said personal water craft. The upper crossed members 35 provide a flat surface for lashing or securing articles or items when engaging in various activities.

In the preferred embodiment of this invention as shown in FIGS. 1 and 2, the multi-purpose storage rack 10 is designed to allow a user to access (open and close) the hood 110 of the personal water craft 100 for storing items. This is accomplished by utilizing a first storage rack 140 and a second storage rack 150. The second storage rack 150 is only attached to the hood 110.

The second storage rack 150 is created by utilizing bolts or other suitable means for attaching the lower crossed member 40 to the bottom 111 of the hood 110 or deck 103, the bottom end 47 of the vertical support members 45 is welded to the lower crossed member 40, the top end 46 of the vertical support members 45 is welded to the upper crossed member 35. The upper crossed member 35 is bolted to the hood.

In an alternative embodiment not shown the first storage rack 140 and the second storage rack 150 can be pivotally mounted to one another at the lower base member 40 to allow the hood 110 to be opened and closed. The second storage rack 140 will have vertical support members 45 pivotally connected to the lower crossed members 40 of the first storage rack, the top end 46 of the vertical support members 45 are welded to the upper crossed member 35 and the upper crossed member 35 of the second storage rack 140 is bolted to the hood 110.

In the preferred embodiment of this invention, the vertical support members 45 are positioned vertically (up and down), in relation to the upper crossed members 35 and the lower base members 40.

However, if a large surface area for holding articles or items is desired, the vertical support members 45 positioned on the edge of the personal water craft can be angled outward and away from the boat to increase the surface area of the upper crossed members 35. Additionally, the vertical support members 45 on the inside of the personal water craft can be angled inward towards the hood of the boat to increase the surface area of the upper crossed members 35 to provide a larger surface area for holding articles or items.

Storing items such as fishing equipment, camping equipment, hunting equipment, water skies, wake boards, scuba diving equipment, inner-tubes and other articles or items is accomplished by lashing or securing the articles or items to the upper crossed members 35, as seen in FIGS. 2 and 3.

FIG. 1 shows that the trolling motor 80 is attached to said personal water craft 100 by means of bolts 50 or other suitable means, which connect said trolling motor 80 to said upper crossed members 35.

Due to the added stability of personal water crafts, a person can utilize a personal water craft 100 for fishing as seen in FIG. 3. The figure also shows that a person can operate a trolling motor 80 while fishing using a fishing pole 90 on a personal water craft 100. The trolling motor 80 is equipped with a mount 82 to securely connect to the multipurpose storage rack 10. The trolling motor also has a handle 84 that is positioned to allow the person on the personal water craft 100 to control the direction and speed of the trolling motor. The trolling motor also has a shaft 86 that connects to the handle 84 and to the propeller 88 which is positioned in the water to allow the person to the control direction. The figure further shows that the multipurpose storage rack can have a sleeping bag 95 lashed to it.

A method of using a personal water craft for carrying items comprising the steps: providing a personal water craft having a hull, a deck disposed on said hull, a hood movably connected to the forward portion of said deck, an engine positioned within the hull, a seat mounted atop said deck for accommodating at least one rider, when seated; and a multi-purpose rack having a surface for carrying one or more items, wherein said multi-purpose rack is disposed forward of said seat and wherein at least a portion of said multi-purpose rack extends outwardly from said hood and said multi-purpose rack is bolted to at least a portion of said deck; wherein said rider positions one or more items on said surface of said multi-purpose rack, said rider then lashes down said items to prevent said items from falling off said personal water craft when said water craft is being utilized in the water.

A method of using a personal water craft to fish comprising the steps: providing a personal water craft having a hull, a deck disposed on said hull, a hood movably connected to the forward portion of said deck, an engine positioned within the hull, a seat mounted atop said deck for accommodating at least one rider, when seated; and a multi-purpose rack which is disposed forwardly of said seat and extends outwardly from said hood of said water craft; said multi-purpose rack is bolted to at least a portion of said deck of said personal water craft; said multi-purpose rack has a surface for carrying one or more items; and a cord for lashing down fishing equipment to said multi-purpose rack to prevent said fishing equipment from falling off said personal water craft when said water craft leaves the shore and is being utilized in the water; wherein said rider reaches the desired location for fishing, said rider un-lashes said fishing equipment from said multi-purpose rack and takes out a fishing pool to fish from said personal water craft; wherein said rider is done fishing, said rider re-lashes said fishing pool and said fishing equipment to said multi-purpose rack, then said rider can return the personal water craft to the shore.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. An apparatus for use on a personal water craft having a hull, a deck disposed on said hull, a hood movably connected to the forward portion of said deck, an engine positioned within the hull, a seat mounted atop said deck for accommodating at least one rider and comprising:

at least one multi-purpose rack attached to said personal water craft;

wherein said multi-purpose rack is disposed in front of said seat;

wherein at least a portion of said multi-purpose rack extends outwardly from said hood to a peripheral edge of said water craft;

wherein said multi-purpose rack has a surface for carrying one or more items wherein said multi-purpose rack has at least two lower base members;

at least two vertical support members;

at least two upper crossed members;

said lower base members are attached to said personal water craft;

said vertical support members have a top end and a bottom end, which are connected to the respective upper crossed members and lower base members; and said upper crossed members have a surface for carrying one or more items.

2. An apparatus, according to claim 1, wherein said item comprises: a fishing equipment, which is lashed to said multi-purpose rack.

3. An apparatus, according to claim 1, wherein said item comprises: a hunting equipment, which is lashed to said multi-purpose rack.

4. An apparatus, according to claim 1, wherein said item comprises: a camping equipment, which is lashed to said multi-purpose rack.

5. An apparatus, according to claim 1, wherein said item comprises: a scuba diving equipment, which is lashed to said multi-purpose rack.

6. An apparatus, according to claim 1, wherein said items comprises: a water ski, which is lashed to said multi-purpose rack.

7. An apparatus, according to claim 1, wherein said item comprises: a wake board, which is lashed to said multi-purpose rack.

8. An apparatus, according to claim 1, wherein said item comprises: an inner tube, which is lashed to said multi-purpose rack.

9. A method of using a personal water craft for carrying items comprising the steps:

providing a personal water craft having a hull, a deck disposed on said hull, a hood movably connected to the forward portion of said deck, an engine positioned within the hull, a scat mounted atop said deck for accommodating at least one rider, when seated; and a multipurpose rack having a surface for carrying one or more items, wherein said multi-purpose rack is disposed forward of said seat and wherein at least a portion of said multi-purpose rack extends outwardly from said hood and said multi-purpose rack is attached to at least a portion of said deck;

wherein said rider positions one or more items on said surface of said multi-purpose rack, said rider then lashes down said items to prevent said items from falling off said personal water craft when said water craft is being utilized in the water;

wherein said multi-purpose rack has at least two lower base members;

at least two vertical support members;

at least two upper crossed members;

said lower base members are attached to at least a portion of said deck;

said vertical support members have a top end and a bottom end, which are connected to the respective upper crossed members and lower base members; and said upper crossed members have a surface for carrying one or more items; and said items are lashed onto said surface of said upper crossed members.

10. An apparatus, according to claim 9, wherein said items comprises: a trolling motor, which is attached to said multi-purpose rack, and fishing equipment, which is lashed to said multi-purpose rack.

11. The method of claim 9, wherein said items are chosen from the group consisting of fishing equipment, hunting equipment, camping equipment, water skies, wake boards, scuba diving equipment, and inner-tubes.

12. A method of using a personal water craft to fish comprising the steps:

providing a personal water craft having a hull, a deck disposed on said hull, a hood movably connected to the forward portion of said deck, an engine positioned within the hull, a seat mounted atop said deck for accommodating at least one rider, when seated; and a multi-purpose rack which is disposed forwardly of said seat and extends outwardly from said hood of said water craft;

said multi-purpose rack is attached to at least a portion of said deck of said personal water craft; said multi-purpose rack has a surface for carrying one or more items; and a cord for lashing down fishing equipment to said multi-purpose rack to prevent said fishing equipment from falling off said personal water craft when said water craft leaves the shore and is being utilized in the water;

wherein said rider reaches the desired location for fishing, said rider un-lashes said fishing equipment from said multi-purpose rack and takes out a fishing pole to fish from said personal water craft;

wherein said rider is done fishing, said rider re-lashes said fishing pole and said fishing equipment to said multi-purpose rack, then said rider can return the personal water craft to the shore.

13. An apparatus for use on a personal water craft having a hull, a deck disposed on said hull, a hood movably connected to the forward portion of said deck, an engine positioned within the hull, a seat mounted atop said deck for accommodating at least one rider and comprising:

at least one multi-purpose rack attached to said personal water craft;

wherein said multi-purpose rack is disposed in front of said seat;

wherein at least a portion of said multi-purpose rack extends outwardly from said hood to a peripheral edge of said water craft;

a first storage rack having at least two lower base members, at least two vertical support members, and upper crossed members;

said lower base members of said first storage rack are attached to at least a portion of said deck of said personal water craft;

said vertical support members of said first storage rack having a top end and a bottom end, which are connected to the respective upper crossed members and lower base members;

a second storage rack having at lease one lower base member, at least one vertical support members, and an upper crossed member;

said lower base member of said second storage rack is attached to said hood of said personal water craft;

said vertical support members of said second storage rack having a top end and a bottom end, which are connected to the respective upper crossed members and lower base members;

said upper crossed members of said second storage rack are attached to said hood of said personal water craft;

wherein said upper crossed members of said first storage rack and said second storage rack have a surface for carrying one or more items;

wherein said upper crossed members of said first storage rack and said second storage rack are not connect to one another wherein said multi-purpose rack has a surface for carrying one or more items.

14. An apparatus for use on a personal water craft having a hull, a deck disposed on said hull, a hood movably connected to the forward portion of said deck, an engine positioned within the hull, a seat mounted atop said deck for accommodating at least one rider and comprising:

at least one multi-purpose rack is attached to said personal water craft;

wherein said multi-purpose rack is disposed in front of said seat;

wherein at least a portion of said multi-purpose rack extends outwardly from said hood to a peripheral edge of said water craft;

a first storage rack having at least one lower base member, at least one vertical support member, and an upper crossed member;

said lower base members of said first storage rack are attached to at least a portion of said deck of said personal water craft;

said vertical support members of said first storage rack having a top end and a bottom end, which are connected to the respective upper crossed members and lower base members;

a second storage rack having at least one vertical support member which has a top end and a bottom end;

said bottom end of said vertical support members of said second rack are pivotally connected to the lower crossed members of said first storage rack;

said top end of the vertical support members of said second rack are connected to an upper crossed member of said second rack and said upper crossed member of the second storage rack is attached to said hood;

said upper crossed members of said first storage rack and said second storage rack have a surface for carrying one or more items;

wherein said multi-purpose rack has a surface for carrying one or more items.

15. An apparatus, according to claim 9, wherein said item comprises: a fishing equipment, which is lashed to said multi-purpose rack.

16. An apparatus, according to claim 9, wherein said item comprises: a hunting equipment, which is lashed to said multi-purpose rack.

17. An apparatus, according to claim 9, wherein said item comprises: a camping equipment, which is lashed to said multi-purpose rack.

18. An apparatus, according to claim 9, wherein said item comprises: a scuba diving equipment, which is lashed to said multi-purpose rank.

19. An apparatus, according to claim 9, wherein said items comprises: a water ski, which is lashed to said multi-purpose rack.

20. An apparatus, according to claim 9, wherein said item comprises: a wake board or inner tube, which is lashed to said multi-purpose rack.

* * * * *